United States Patent [19]

Leonard et al.

[11] Patent Number: 4,885,129

[45] Date of Patent: Dec. 5, 1989

[54] METHOD OF MANUFACTURING HEAT PIPE WICKS

[75] Inventors: John F. Leonard; Jerry E. Beam, both of Beavercreek, Ohio

[73] Assignee: The United States of America as represented by the Secretary of the Air Force, Washington, D.C.

[21] Appl. No.: 261,809

[22] Filed: Oct. 24, 1988

[51] Int. Cl.[4] ..... B22F 5/00

[52] U.S. Cl. ..... 419/2; 29/157.3 R; 29/157.3 H; 419/8; 419/36; 419/40

[58] Field of Search ..... 29/157.3 H, 157.3 R, 29/527.1, 527.2; 419/2, 8, 36, 40; 427/231, 239

[56] References Cited

U.S. PATENT DOCUMENTS

| | | | |
|---|---|---|---|
| 3,666,005 | 5/1972 | Moore, Jr. | 165/105 |
| 3,681,843 | 8/1972 | Arcella et al. | 29/157.3 H |
| 3,762,011 | 10/1973 | Staudhammer et al. | 29/157.3 R |
| 3,840,069 | 10/1974 | Fischer et al. . | |
| 3,911,547 | 10/1975 | Vinz | 29/157.3 R |
| 4,039,703 | 8/1977 | Kamijo et al. | 427/231 |
| 4,082,863 | 4/1978 | Dancy et al. | 427/181 |
| 4,196,504 | 4/1980 | Eastman | 419/2 |
| 4,274,479 | 6/1981 | Eastman | 165/104.26 |
| 4,305,756 | 12/1981 | Wiech, Jr. | 419/36 |
| 4,404,166 | 9/1983 | Wiech, Jr. | 419/36 |
| 4,461,343 | 7/1984 | Token et al. | 165/104.26 |
| 4,760,878 | 8/1988 | Fukui et al. | 427/239 |
| 4,765,950 | 8/1988 | Johnson | 419/36 |

FOREIGN PATENT DOCUMENTS

| | | | |
|---|---|---|---|
| 553299 | 2/1958 | Canada | 419/2 |
| 51-11006 | 1/1976 | Japan | 29/157.3 H |

*Primary Examiner*—P. W. Echols
*Assistant Examiner*—Irene Cuda
*Attorney, Agent, or Firm*—Fredric L. Sinder; Donald J. Singer

[57] ABSTRACT

A new method for making a sintered metal heat pipe wick is practiced by mixing nickel powder into a slurry with a viscous binder comprising water. Polyox and Methocel. The mixture is then injected inside a rotating stainless steel cylindrical heat pipe container, or pipe, to completely coat the inside surface of the pipe. The rotational rate of the pipe is then increased to force the slurry to level out to a uniform depth set by the thickness of sleeves attached at each end of the pipe. Forced air is then blown through the inside of the rotating pipe to dry the slurry and form a green wick. After stopping rotation of the pipe, it is then heated inside a sintering oven in a reducing atmosphere to disintegrate the binder and leave a sintered metal final composition of the wick. Thus produced wicks prevent "hot spots" because they have a more uniform thickness and are attached more evenly and securely than prior art heat pipe wicks to the inside walls of the heat pipe container.

10 Claims, 3 Drawing Sheets

METHOD OF MANUFACTURING HEAT PIPE WICKS

RIGHTS OF THE GOVERNMENT

The invention described herein may be manufactured and used by or for the Government of the United States for all governmental purposes without the payment of any royalty.

CROSS-REFERENCE TO RELATED APPLICATIONS

This application relates to five companion applications titled: A METHOD OF MANUFACTURING HEAT PIPE WICKS AND ARTERIES. U.S. application Ser. No. 071261.807 (Air Force Docket No. AF18278); UNIDIRECTIONAL HEAT PIPE AND WICK, U.S. application Ser. No. 071261.808 (Air Force Docket No. AF18413); ELECTRICAL BATTERY CELL WICKING STRUCTURE AND METHOD, U.S. application Ser. No. 071261.804 (Air Force Docket No. AF18277A); RIGIDIZED ,POROUS MATERIAL AND METHOD, U.S. application Ser. No. 071261.803 (Air Force Docket No. AF18277B); and, ALKALI AND HALOGEN RECHARGEABLE CELL WITH REACTANT RECOMBINATION, U.S. application Ser. No. 071261.802 (Air Force Docket No. AF17953), all filed on the same date as this application and hereby incorporated by reference as if fully rewritten herein. Some of the applications have different named inventors and all of the applications are subject to an obligation of assignment to the Government of the United States as represented by the Secretary of the Air Force.

BACKGROUND OF THE INVENTION

This invention relates generally to heat pipes, and more specifically to methods for making sintered metal heat pipe wicks.

Heat pipes use successive evaporation and condensation of a working fluid to transport thermal energy, or heat, from a heat source to a heat sink. Because most fluids have a high heat of vaporization, heat pipes can transport in a vaporized working fluid very large amounts of heat. Further, the heat can be transported over relatively small temperature differences between the heat source and heat sink. Heat pipes generally use capillary forces through a porous wick to return condensed working fluid, or condensate, from a heat pipe condenser section (where transported thermal energy is given up at the heat sink) to an evaporator section (where the thermal energy to be transported is absorbed from the heat source).

Heat pipe wicks are typically made by wrapping metal screening of felt metal around a cylindrically shaped mandrel, inserting the mandrel and wrapped wick inside a heat pipe container and then removing the mandrel. Thus constructed heat pipe wicks are particularly susceptible to developing hot spots where the liquid condensate being wicked back to the evaporator section boils away and impedes or blocks liquid movement. Such hot spots usually occur at gaps between the wick and the inside wall of the container, and also at nonhomogeneous locations, such as dense areas or relatively large voids, in the wick structure itself. These gaps and other nonhomogeneties are nearly impossible to avoid using conventional wick construction methods.

Gaps between the container and wick arise primarily from difficulties in attaching or adhering the wick structure to the inside wall. The wick is generally force fit inside the container so that residual internal stresses hold it in place. Unfortunately, over time the high temperatures from operation of the heat pipe anneal the wick, which reduces the internal stresses and allows the wick to pull away from the inside wall. Attempts to use bonding agents or cements to bond the wick structure to the inside wall meet with the difficulty, shared with the binders used to make felt metal, that typical bonding agents disintegrate at high pipe temperatures.

Nonhomogeneties are inherent in most wick structures. Prior art attempts to make a more homogeneous, or more uniformly nonhomogeneous, wick structure, and also to avoid the problems caused by annealing, include the use of sintered metal heat pipe wicks. Sintered metal is attractive as a wicking material because it is easily formed into a variety of shapes and the prior art has developed a variety of methods for making sintered metal of varying porosity and differing morphologies. Prior art sintered metal wicks have been made primarily by filling powered metal into the space between a mandrel and a heat pipe container and then heating the powder to sinter together the individual particles and make a porous wick. The mandrel, having been previously surface treated to aid separation, is then removed from inside the sintered wick. Unfortunately, these methods for making sintered metal wicks produce wicks that still suffer from nonhomogeneties and from an imperfect fit between the inside surface of the container and the wick. A particular problem with such methods is that it is very difficult to keep an even spacing between the mandrel and inside wall to produce a wick of even thickness.

Another attempt by the prior art to avoid wick material problems includes using, instead of wick material, longitudinal grooves in the heat pipe container inside wall to wick condensate back to the evaporator section. Grooves and other structural wicking aids, however, are used most advantageously in combination with porous wicks.

Thus it is seen that there is a need for improved heat pipe wicks that avoid both nonhomogeneties in the wick material and gaps between the container inside wall and the wick.

It is, therefore, a principal object of the present invention to provide an improved method for making sintered metal heat pipe wicks that are homogeneous and firmly attached without gaps to the inside wall of the heat pipe container.

It is another object of the invention to provide a method for making sintered metal heat pipe wicks that are of exceptionally accurate and even thickness over the heat pipe container inside wall.

It is a feature of the invention that it produces sintered metal heat pipe wicks of uniformly varying pore sizes.

It is another feature of the invention that it uses a precursor wick material comprising a slurry that can be poured over a variety of different heat pipe container inside wall shapes and attachments so that the final heat pipe wick provides a complete cover for such attachments without substantially interfering with the operation of the wick.

It is an advantage of the invention that its use of a pourable slurry permits making a wick in tight spaces and around corners so that it can be used to manufacture wicks of complex shapes.

SUMMARY OF THE INVENTION

In accordance with the foregoing principles and objects of the present invention, a novel method of making sintered metal heat pipe wicks is described that provides an excellent capillary wick which securely adheres to the inside wall of a heat pipe container and which has an uniquely uniform structure and thickness over the length of the heat pipe. The unique discoveries of the present invention are that suspending metal particles in a viscous binder to make a slurry keeps the particles separate so that, when heat treated by sintering, the binder burns off leaving a wick of uniformly varying pore size and improved wicking properties; and, that coating the inside of a spinning heat pipe container with the slurry and then air drying the slurry to form a green wick while continuing to spin the container produces a wick of uniform composition and thickness and with excellent adherence to the inside wall of the heat pipe container.

Accordingly, the present invention is directed to a method for making a heat pipe wick on an inside surface of a heat pipe container, comprising the steps of providing a slurry of metal particles suspended in a viscous binder; coating at least part of the inside surface of the container with the slurry; rotating the container so that the slurry generally covers the inside surface of the container; while continuing to rotate the container, drying the slurry to form a green wick; and, heat treating the green wick to yield a final composition of the heat pipe wick.

The invention also includes the use of a pair of inwardly extending wall means from the heat pipe container inside surface for determining the thickness of the slurry coating. The wall means may be provided by inserting sleeves inside each end of the heat pipe container.

Drying the slurry may be by blowing air inside the rotating container. Heat treating the heat pipe wick may be by heating the green wick in a reducing gas atmosphere held above the decomposition temperature of the viscous binder and below the melting point of the metal particles to yield a sintered metal heat pipe wick.

The metal particles used in the slurry may be made from a metal selected from the group consisting of nickel, copper, molydenum, aluminum and their alloys.

The invention further includes successively repeating the disclosed process to produce a compound heat pipe wick. The metal particles of each successive slurry layer are preferably smaller than the metal particles of each preceding slurry layer.

BRIEF DESCRIPTION OF THE DRAWINGS

The present invention will be more clearly understood from a reading of the following detailed description in conjunction with the accompanying drawings wherein.

DETAILED DESCRIPTION OF THE INVENTION

Figure 1:
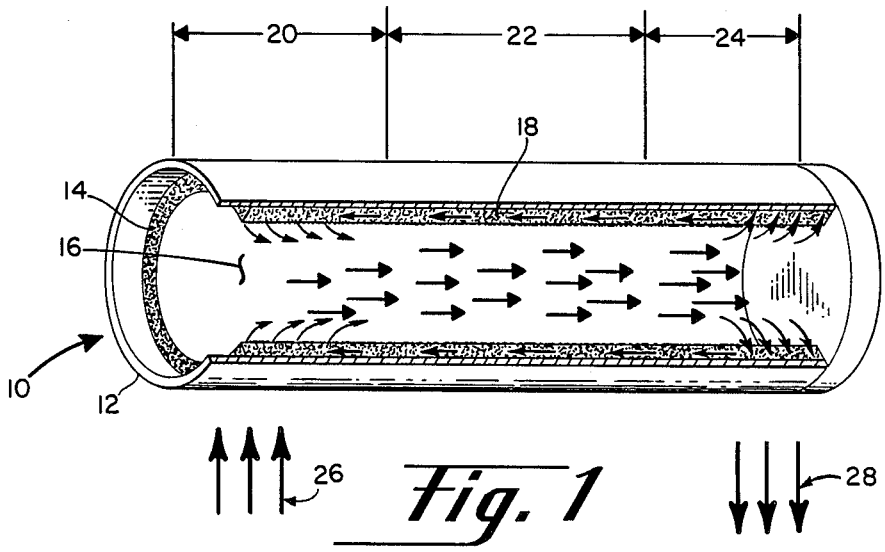
Fig. 1 PRIOR ART
FIG. 1 is a longitudinal cutaway view of a typical heat pipe showing the organization of its elements and its manner of operation.

Referring now to FIG. 1, there is shown a longitudinal cutaway view of a typical heat pipe 10. Heat pipe 10 is shown shorter than is typical to show all elements in one figure. The primary elements of heat pipe 10 are a hermetically sealed container 12, a wick 14 and an interior vapor space 16. To reveal details, one end cap for sealed container 12 is not shown. Saturated inside wick 14 is a liquid working fluid 18, which may be ammonia, methanol, water, sodium, lithium, fluorinated hydrocarbons or any number of fluids selected for their high heat of vaporization and having an acceptable vaporization temperature in a preselected range within which the heat pipe will operate. Heat pipe 10 typically includes an evaporator section 20, an adiabatic section 22 and a condenser section 24. The adiabatic section is not necessary to the operation of the heat pipe, but is found in some heat pipe applications.

In operation, the evaporator section 20 of the heat pipe is placed into thermal contact with a heat source 26 and the condenser section 24 placed into thermal contact with a heat sink 28. As thermal energy from heat source 26 is supplied to evaporator section 20, liquid working fluid 18 is impregnating the wick absorbs the thermal energy and begins to vaporize, undergoing a phase change from liquid to vapor. The vapor pressure from vaporization forces the vapor through vapor space 16 toward condenser section 24 of the heat pipe. Because condenser section 24 is at lower temperature than evaporator section 20 and the vaporization temperature of working fluid 18, the vapor condenses back into a liquid, giving up to heat sink 28 its latent heat of vaporization which was acquired in evaporator section 20. The now again liquid phase working fluid 18 is absorbed by wick 14 in condenser section 24 and capillary action wicks the liquid back toward evaporator section 20 where it is again available for evaporation. This process will rapidly reach equilibrium and operate continuously as long as heat is supplied.

Figure 2:
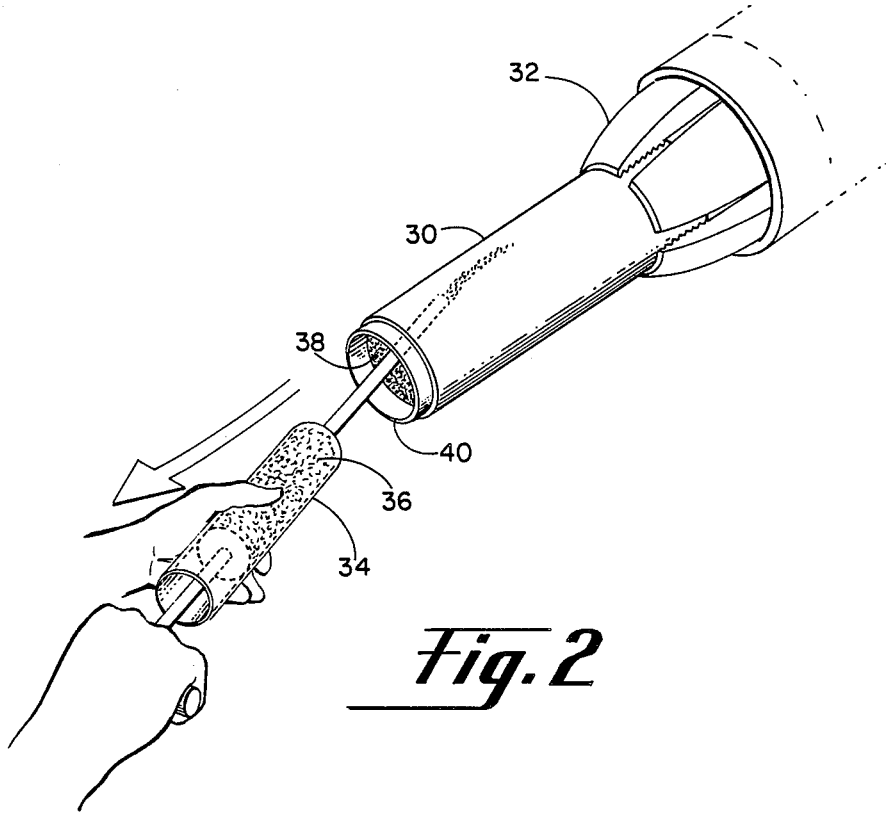
FIG. 2 is a perspective view of a heat pipe container mounted at one end inside a spinning lathe chuck and showing the injection at its other end of a slurry of metal particles in a viscous binder according to the teachings of the present invention.
Figure 3:
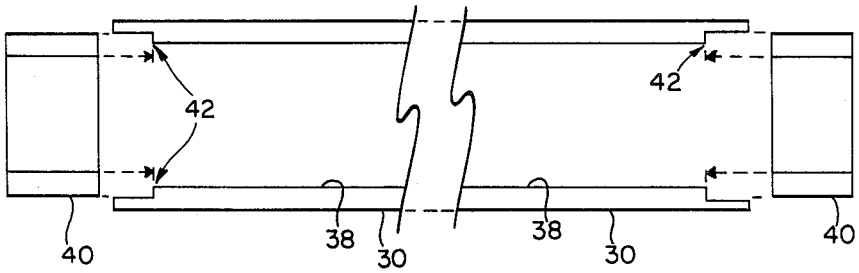
FIG. 3 is a longitudinal cross-sectional view of a heat pipe container showing the use of sleeves for forming radially inward walls or steps.

FIG. 2 shows a perspective view of an unsealed heat pipe container 30, made in this embodiment from a stainless steel pipe, mounted in a lathe chuck 32. For clarity, container pipe 30 is shown shorter than actual and chuck 32 is shown separated from the lathe of which it is a part. While spinning pipe 30 at approximately 200 rpm, an injector 34 containing a slurry 36, described in more detail below, is slowly removed through the length of pipe 30 to coat its inside wall or surface 38 with slurry 36. The rate of rotation of pipe 30 is then increased to approximately 3000 rpm so that slurry 36 is forced out against inside wall 38. FIG. 3 shows the use of previously inserted sleeves 40 which, when inserted into the ends of pipe 30, extend radially inward from inside wall 38 to provide steps or walls 42 for setting the final coating thickness of slurry 36.

Slurry 36 comprises a powder of metal particles suspended in a viscous binder. In this embodiment, the powder comprises nickel particles of sizes from about 3 to 5 microns. Type 255 MOND metal powder from International Nickel has worked successfully. The nickel powder is mixed into a binder comprising, in this embodiment, water, Polyox, a high molecular weight polymer of ethylene oxide available from Union Carbide Corporation, and Methocel, a methyl cellulose binder material available from Dow Corning Corporation. A mixture of 1 gram of Methocel, 1 gram of Polyox, 100 grams of nickel powder and 110 grams of water has made a successful wet and viscous binder. Slight changes in proportions may be made to finely adjust the final viscosity of the slurry.

Figure 4:
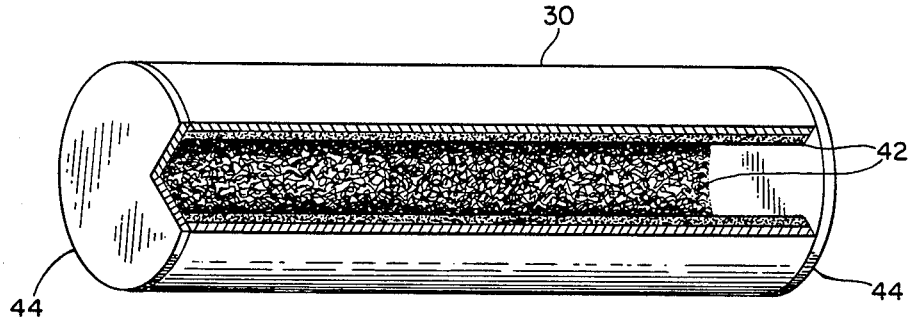
FIG. 4 is a longitudinal cutaway view of a heat pipe having a sintered metal wick made according to the teachings of the present invention; and, FIG. 5 is a simplified flow chart showing an example sequence of steps to produce a heat pipe wick according to the teachings of the present invention.

After rotating slurry 36 reaches equilibrium against inside wall 38, cool air is blown inside pipe 30 to dry slurry 36 and form a green wick. A laboratory hot air gun set on its cool setting used for a period of about two hours has worked successfully. Pipe 30 is then removed from lathe chuck 32 and placed inside a sintering oven for approximately five to thirty minutes at 1000° C. A reducing atmosphere (typically made by adding hydrogen or other reducing gas) is maintained inside the sintering oven to prevent or remove oxides that tend to form on the metal surfaces and interfere with successful sintering of one particle to another. The sintering oven is held at a temperature level chosen to be above the decomposition temperature of the (generally organic) binder material and below the melting point of the metal particles. The viscous binder disintegrates at the high sintering temperatures leaving a wick material 42, shown in FIG. 4, with a porosity of 75 to 95 percent. Wick material 42 shrinks approximately 50% during the sintering process. Lastly, the sleeved 40 ends are cut off and end caps 44 fitted and welded into place to seal pipe 30.

In view of a tendency for the reducing gas to attack a sintered wick at temperature in the 800° C. range during a cooldown sequence, the sintering oven atmosphere is preferably changed to an inert gas mixture prior to cooldown.

A particular advantage of using a highly viscous binder to form slurry 36 is that the viscosity holds the individual metal particles apart in a spaced relationship so that the final wick material 42 of sintered metal particles is highly porous. Micro-photographs of the final sintered wick material 42 show that the metal particles tend to agglomerate during the sintering process to form relatively large pores surrounded by porous walls of touching metal particles. There is about a 50 to 1 ratio of the size of the large pores to the smaller pores formed within the walls. Experiments have shown that this varying pore size wick, sometimes referred to as uniformly nonhomogeneous, wicks liquids at rates and for distances up to nine times faster than wick material of more conventional structure.

Figure 5:
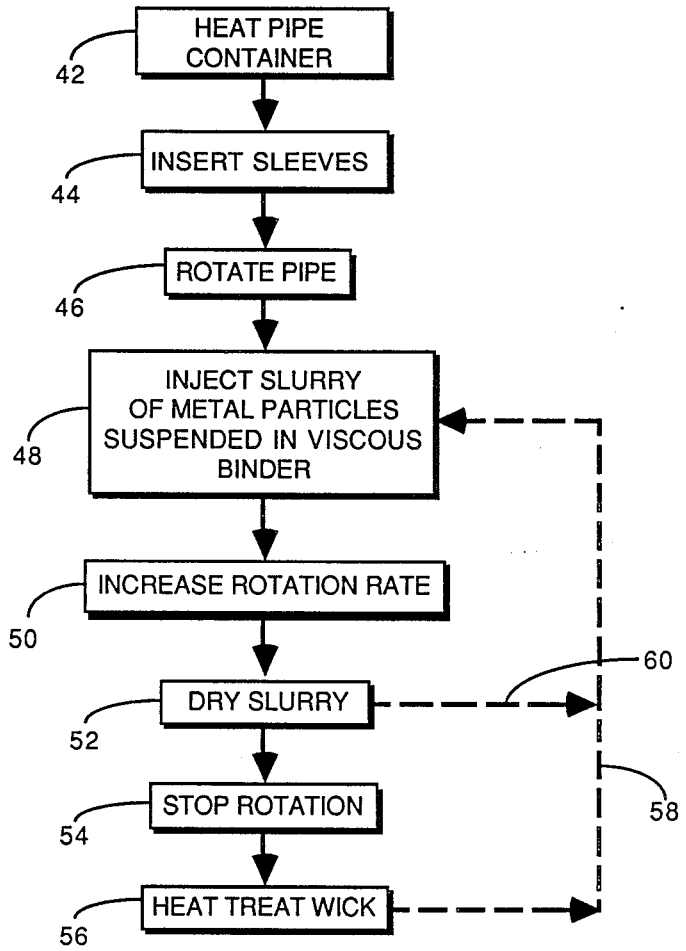

FIG. 5 is a simplified flow chart of an example sequence of steps to produce a heat pipe wick according to the teachings of the present invention. Those with skill in the field of art of the invention will readily see from examination of FIG. 5 that the invention may be expanded to, for example, provide a multiple layer compound wick structure by, after performing steps 42 through 56, returning along path 58 to repeat steps 46 through 56 to form successive, or inner, wick layers. Preparation of the successive wick layers may alternately be made by proceeding along path 60, beginning after step 52 instead of after step 56.

Controlling the thickness of each wick layer may be made by using a succession of sleeves, a stepped sleeve or any variety of methods for making wall means or steps. Increasing experience with making wicks will also permit accurate control of layer thickness by controlling the amount of slurry injected or deposited.

It is preferable in making a compound wick to use smaller metal particles, producing consequently smaller pores, for each successive inner layer.

Those with skill in the field of the invention will see that the use of a slurry as the precursor wick material makes possible forming the wick over a variety of different shapes and attachments to the inside wall of a heat pipe container. For example, a microprocessor controlling a variety of heat pipe functions may advantageously be placed on the inside surface of the heat pipe container. The ability to pour the precursor slurry ensures that the final wick will fill in all openings and perfectly cover the microprocessor. Similarly, otherwise awkward wall shapes, bends and projections are provided for automatically. The force from spinning the pipe further ensures the accurate filling in of the wick material.

Those with skill in the field of the invention will also see that the drying step may be accomplished by a variety of methods, such as by vacuum drying, in addition to by blowing cool air.

The disclosed method successfully demonstrates making a sintered metal heat pipe wick having a structure providing improved wicking properties, a superiorly uniform composition and thickness and with excellent adherence to heat pipe container inside walls. Although the disclosed process is specialized, extension of its underlying methodology will find application in other areas where prior art construction methods, such as mechanical bending and shaping or filling a mold, do not produce a completely successful product.

It is understood that other modifications to the invention as described may be made, as might occur to one with skill in the field of this invention. Therefore, all embodiments contemplated have not been shown in complete detail, and other embodiments may be developed without departing from the spirit of the invention or from the scope of the claims.

We claim:

1. A method for making a heat pipe wick on an inside surface of a heat pipe container, comprising the steps of:

(a) providing a slurry of metal particles suspended in a viscous binder;

(b) coating at least part of the inside surface of the container with the slurry;

(c) rotating the container so that the slurry generally covers the inside surface of the container;

(d) while continuing to rotate the container, drying the slurry to form a green wick; and, (e) heat treating the green wick to yield a final composition of the heat pipe wick.

2. The method for making a heat pipe wick according to claim 1, further comprising the step of providing a pair of wall means for extending radially inwardly at preselected distances from the inside surface of the container so that the slurry forms a substantially uniform coating over the inside surface of the container between the provided wall means at a thickness substantially that set by the provided wall means.

3. The method according to claim 2, wherein the wall means are provided by inserting sleeves inside each end of the heat pipe container.

4. The method for making a heat pipe wick according to claim 1, wherein drying the slurry to form a green wick comprises blowing air inside the rotating container.

5. The method according to claim 1, wherein the metal particles are made from a metal selected from the group consisting of nickel, copper, molydenum, aluminum and their alloys.

6. A method for making a heat pipe wick on an inside surface of a heat pipe container, comprising the steps of:

(a) providing a slurry of metal particles suspended in a viscous binder;

(b) coating at least part of the inside surface of the container with the slurry;

(c) rotating the container so that the slurry generally covers the inside surface of the container;

(d) while continuing to rotate the container, drying the slurry to form a green wick;

(e) heat treating the green wick to yield a final composition of the heat pipe wick; and, (f) wherein the heat treating comprises heating the green wick in a reducing gas atmosphere held above the decomposition temperature of the viscous binder and below the melting point of the metal particles to yield a sintered metal heat pipe wick.

7. A method for making a heat pipe compound wick on an inside surface of a heat pipe container, comprising the steps of;

(a) for a preselected number of times, successively:

(i) providing a slurry of metal particles suspended in a viscous binder;

(ii) coating at least part of the inside surface of the container with the slurry;

(iii) rotating the container so that the slurry forms a coating layer over the inside surface of the container; and, (iv) while continuing to rotate the container, drying the slurry to form a green wick layer; and, (b) heat treating the compound green wick to yield a final composition of the heat pipe wick.

8. A method for making a heat pipe compound wick on an inside surface of a heat pipe container, comprising the steps of:

(a) for a preselected number of times, successively:

(i) providing a slurry of metal particles suspended in a viscous binder;

(ii) coating at least part of the inside surface of the container with the slurry;

(iii) rotating the container so that the slurry forms a coating layer over the inside surface of the container; and, (iv) while continuing to rotate the container, drying the slurry to form a green wick layer;

(b) heat treating the compound green wick to yield a final composition of the heat pipe wick; and, (c) wherein the metal particles of each successive slurry layer are generally smaller than the metal particles of the preceding slurry layer.

9. A method for making a heat pipe compound wick on an inside surface of a heat pipe container, comprising the steps of, for a preselected number of times, successively:

(a) providing a slurry of metal particles suspended in a viscous binder;

(b) coating at least part of the inside surface of the container with the slurry;

(c) rotating the container so that the slurry forms a coating layer over the inside surface of the container; and, (d) while continuing to rotate the container, drying the slurry to form a green wick layer; and, (e) heat treating the green wick layer to yield a final composition of that wick layer.

10. A method for making a heat pipe compound wick on an inside surface of a heat pipe container, comprising the steps of, for a preselected number of times, successively:

(a) providing a slurry of metal particles suspended in a viscous binder;

(b) coating at least part of the inside surface of the container with the slurry;

(c) rotating the container so that the slurry forms a coating layer over the inside surface of the container;

(d) while continuing to rotate the container, drying the slurry to form a green wick layer;

(e) heat treating the green wick layer to yield a final composition of that wick layer; and, (f) wherein the metal particles of each successive slurry layer are generally smaller than the metal particles of the preceding slurry layer.

* * * * *